US006637160B2

(12) United States Patent
Brooks

(10) Patent No.: US 6,637,160 B2
(45) Date of Patent: Oct. 28, 2003

(54) TELESCOPIC ENCLOSURE

(76) Inventor: Bob Brooks, 46 Saint Marks Pl., Massapequa, NY (US) 11758

( * ) Notice: Subject to any disclaimer, the term of this patent is extended or adjusted under 35 U.S.C. 154(b) by 0 days.

(21) Appl. No.: 09/902,417

(22) Filed: Jul. 10, 2001

(65) Prior Publication Data

US 2003/0014927 A1 Jan. 23, 2003

(51) Int. Cl.[7] ..... E04B 1/346; E04B 7/16

(52) U.S. Cl. ..... 52/66; 52/67; 135/119; 135/129; 49/163; 4/502; 4/503; 160/272; 160/273.1; 296/100.03; 296/100.17; 296/105

(58) Field of Search ..... 52/65, 66, 63, 52/67; 135/96, 115, 116, 119, 124, 129; 49/163, 505; 4/502, 503, 498; 160/272, 273.1; 296/100.03, 105, 100.17

(56) References Cited

U.S. PATENT DOCUMENTS 3,766,691 A * 10/1973 Ray ..... 52/63
4,280,306 A * 7/1981 Milinic ..... 52/63
4,783,861 A * 11/1988 Leurent ..... 4/498
5,507,121 A * 4/1996 Taylor ..... 52/66

* cited by examiner

*Primary Examiner*—Carl D. Friedman
*Assistant Examiner*—Yvonne M. Horton
(74) *Attorney, Agent, or Firm*—Michael I. Kroll

(57) ABSTRACT

The present invention 10 discloses a plurality of movable transparent arcuate sections 12 that can roll on their own designated tracks 14 to enclose or expose a sun room or pool area 18. Thus, the present invention 10 is comprised of a plurality of overlapping transparent arcuate arches or sections 12 positioned on parallel tracks 14. The arches 12 can be selectively moved to any position on the parallel tracks 14. The two distal end arches have removable end closure panels 20. Each of the transparent panel members 22 or arch 12 are positioned within a frame member 16 having a plurality of wheels 36 engaging the spaced apart track members 14. Track members 14 are fixedly positioned to the ground or foundation structures 58 in a spaced-apart parallel configuration. Each side of an arch 12 consists of a plurality of wheels 36 fixedly positioned between spaced apart track elements 14 having hook-like terminations 53 to prevent dislocation of the frame member 16 from the track member 14. Each arch 12 is slidably positioned on its respective track 14 before plugs 54 are inserted into each track rail distal end.

16 Claims, 21 Drawing Sheets

TELESCOPIC ENCLOSURE

BACKGROUND OF THE INVENTION

1. Field of the Invention

The present invention relates generally to outdoor enclosures and more specifically to a telescopic enclosure providing a plurality of transparent rolling sections that can roll on their own designated tracks to enclose or expose a sun room or pool area to the elements.

The present invention is comprised of a plurality of overlapping transparent arches positioned on parallel tracks. The arches can be selectively moved to any position on the parallel tracks. The two distal end arches have removable closure panels. Each of the arches transparent members are positioned within a frame member having a plurality of wheels engaging spaced apart track members.

Track members are fixedly positioned to the ground or foundation structures in a spaced apart parallel configuration. Each side of an arch consists of a plurality of wheels fixedly positioned between spaced apart track wall elements having hook like terminations to prevent dislocation of the frame member from the track member. Each arch is rollably positioned on its respective track before plugs are inserted into each track rail distal end.

2. Description of the Prior Art

There are other exterior enclosure apparatus designed to enclose pool areas and deck areas. Typical of these is U.S. Pat. No. 3,979,782 issued to Lamb on Sep. 14, 1976.

Another patent was issued to Kumode on Nov. 27, 1979 as U.S. Pat. No. 4,175,361. Yet another U.S. Pat. No. 4,381,629 was issued to Ahn on May 3, 1983 and still yet another was issued on Apr. 21, 1987 to Martin et al. as U.S. Pat. No. 4,659,136.

Another patent was issued to Ozdemir on Aug. 4, 1987 as U.S. Pat. No. 4,683,686. Yet another patent was issued to Wardell et al on Aug. 20, 1996 as U.S. Pat. No. 5,546,972 and still yet another patent was issued to Lonnberg on Nov. 3, 1998 as U.S. Pat. No. 5,829,204.

Another patent was issued to Last on Dec. 8, 1998 as U.S. Pat. No. 5,845,343. Another patent was issued to Last on Sept. 14, 1999 as U.S. Pat. No. 5,950,253.

U.S. Pat. No. 3,979,782

Inventor: Joe Lamb

Issued: Sep. 14, 1976

A protective swimming pool covering apparatus is disclosed wherein the apparatus includes a flexible impervious cover sheet capable of being extended and retracted over a swimming pool. Each lateral side of the cover sheet is adapted with a longitudinally beaded side edge which is slidably held in a longitudinal open channel or track cut into a slide way member fixed to the longitudinal margins of the swimming pool. The longitudinal opening of the slide way means is sized such that it is slightly smaller than the diameter of the beaded side edge such that under normal operating conditions the bead will be slidably held within the track or channel. However, under conditions of excessive lateral stress, the bead will be sufficiently compressed and be pulled through the opening and away from the channel. In addition, the end sections of the slide way means is adapted with a stationary channeled guide piece having a pair of flared end sections and a longitudinal side opening. The stationary guide piece is mounted such that the channels of the guide piece and the slide way means are in aligned registry with each other. The longitudinal side opening of the stationary guide piece is substantially smaller than the longitudinal side opening of the slide way means making disengagement of the bead from the channel opening substantially more difficult than that from the slide way means.

U.S. Pat. No. 4,175,361

Inventor: Masami Kumode

Issued: Nov. 27, 1979

An openable canopy housing having a series of movable, telescoping transparent arched panels which form the combination roof and sides. Part of the roof of the housing is formed by a horizontal beam which runs the length of the structure. The transparent panels can be selectively opened or closed to provide a structure which can be used for indoor as well as outdoor use.

U.S. Pat. No. 4,381,629

Inventor: Min H. Ahn

Issued: May 3, 1983

A greenhouse comprising walls defining an area. A roof covers a portion of the area. Track means are interposed between the roof and the walls so that the roof may be moved along the track to cover a selected part of the area.

U.S. Pat. No. 4,659,136

Inventor: John Martin et al.

Issued: Apr. 21, 1987

An improved apparatus for covering at least a part of the open bed of a land or marine vehicle or the like includes an enclosure structure telescopically collapsible and extendable with an access opening and door assembly rearward longitudinally movable portion thereof. An improved end gate assembly is selectively positionable and releasably securable at a number of continuously variable longitudinal locations on the open bed, corresponding with the movable rearward section of the enclosure. The apparatus also includes an improved track assembly for the telescopically collapsible and extendable enclosure sections, with apparatus for substantially preventing or minimizing the accumulation of corrosion, water or other foreign materials that would hinder the smooth and free operation of the enclosure structure.

U.S. Pat. No. 4,683,686

Inventor: Veli Ozdemir

Issued: Aug. 4, 1987

A removable enclosure cover for a swimming pool or the like is disclosed. The enclosure cover includes a plurality of rigid frame members of rectangular panel sections. The frame members are spaced apart and extend parallel to one another transversely across the pool area. A flexible material is stretched between the frame members. A pair of spaced parallel channel-shaped track members extend along the sides of the pool and guide means is attached to the lower ends of each of the frame members. The guide means has rollers which extend into the interior of the track members. One roller rolls along the bottom of the track members and is mounted on a vertically movable carriage, permitting the frame members to be moved together to one end of the pool deck and collapsing the flexible material to uncover the pool. A threaded adjustment is provided for raising and lowering the carriage with the roller thereon so that the top portion of the track may be clamped between the roller carriage and the bottom of the frame member. The other roller is adapted to engage the sides of the track member to longitudinally guide the frame members.

U.S. Pat. No. 5,546,972

Inventor: Jacqueline R. Wardell et al.

Issued: Aug. 20, 1996

A collapsible cover system and kit therefore are removably mounted to a plurality of spaced stake sockets secured within longitudinally extending areas on opposite sides of a swimming pool or hot tub. Stakes, disposed in the stake sockets, are slidingly connected to two lengths of spaced guide tracks that extend along the sides of the pool or hot tub. Inverted bow-shaped members having free ends are removably secured to carrier means that slidingly connect the bow-shaped members to the guide. In additional embodiments the spaced guide tracks are deposed either in a trough that may be covered when the particular rail sections are not in use, or hingedly deposed adjacent a trough into which rail particular rail sections may be stored when they are not in use.

U.S. Pat. No. 5,829,204

Inventor: Benth Lonnberg

Issued: Nov. 3, 1998

An arrangement for openable roofs, especially for glazed verandas and balconies. The arrangement is a horizontal supporting section (10) which defines an elongated guiding channel (11) having an elongated side opening (12), and a horizontal roofing panel (20) which is movable in the longitudinal direction of the supporting section (10). The roof panel (20) has a lateral edge (21) that extends into the guide channel (11) of the supporting section (10). A plurality of separate guiding and spacing members (40) are mounted spaced from each other in a direction of the guiding channel (11), on the lateral edge (21), received in the guiding channel (11), and abuts against the inner wall of the guiding channel (11) to thereby ensure that there is a play both upwards and downwards in the side opening (12) between the panel (20) and the supporting section (10). The guiding and spacing members (40) are designed so as to allow a turning movement of the panel (20). Compressible sealing means (50) are arranged in the guiding channel (11) between the side opening (12) and the guiding and spacing members (40).

U.S. Pat. No. 5,845,343

Inventor: Harry Last

Issued: Dec. 8, 1998

A track assembly for allowing movement of a flexible enclosure cover over an area to be enclosed as, for example, a body of water in a swimming pool. The assembly comprises a pair of spaced apart tracks mounted on opposite sides of the area to be enclosed with each being comprised of an elongate strip. Each track strip comprises a cable receiving channel with a gutter or debris trough located generally beneath the channel for collection of debris. Preferably, a slider can be located in the cable receiving channel for locking to the cable and for securement of the cover to the cable. The track can be constructed to also allow for lubrication of the cable receiving channel enabling a slider mechanism to freely move therein. When a slider is used, it extends into each channel at approximately a 45-degree angle with respect to a vertical direction. In accordance with this construction, debris which might otherwise collect in the cable receiving channel will drop into the gutter and will not interfere with movement of the slider mechanism or the leading edge of the cover. The slider may be adjustably secured to a rigid body which is, in turn, secured to the leading edge of the cover, and which allows side-to-side adjustment of the leading edge. Adjustment in the 45 degree. angulated plane could reduce bending moment forces on the slider and track.

U.S. Pat. No. 5,950,253

Inventor: Harry Last

Issued: Sep. 14, 1999

A track assembly for allowing movement of a flexible enclosure cover over an area to be enclosed as, for example, a body of water in a swimming pool. The assembly comprises a pair of spaced apart tracks mounted on opposite sides of the area to be enclosed with each being comprised of an elongate strip. Each track strip comprises a cable receiving channel with a gutter or debris trough located generally beneath the channel for collection of debris. Preferably, a slider can be located in the cable receiving channel for locking to the cable and for securement of the cover to the cable. The track can be constructed to also allow for lubrication of the cable receiving channel enabling a slider mechanism to freely move therein. When a slider is used, it extends into each channel at approximately a 45 degree. angle with respect to a vertical direction. In accordance with this construction, debris which might otherwise collect in the cable receiving channel will drop into the gutter and will not interfere with movement of the slider mechanism or the leading edge of the cover. The slider may be adjustably secured to a rigid body which is, in turn, secured to the leading edge of the cover, and which allows side-to-side adjustment of the leading edge. Adjustment in the 45 degree. angulated plane could reduce bending moment forces on the slider and track.

SUMMARY OF THE PRESENT INVENTION

The present invention discloses a plurality of movable transparent arcuate sections or arches that can roll on their own designated parallel tracks to enclose or expose a sun room or pool area. The arches can be selectively moved to any position on the parallel tracks. The two distal end arches have removable end closure panels. Each of the transparent members of the arches are positioned within a frame member having a plurality of wheels engaging the spaced apart track members. Track members are fixedly positioned to the ground or foundation structures in a spaced-apart parallel configuration. Each side of an arch consists of a plurality of wheels fixedly positioned between spaced apart track elements having hook-like terminations to prevent dislocation of the frame member from the track member. Each arch is slidably positioned on its respective track before plugs are inserted into each track rail distal end.

A primary object of the present invention is to provide a telescopic enclosure providing a plurality of sliding sections which slide on their own designated, respective track and slide over one another in order to enclose or expose a sun room or swim pool to the elements.

Another object of the present invention is to provide a telescopic enclosure providing a plurality of overlapping glazed arches positioned on parallel tracks. The arches can be selectively moved to any position on the parallel tracks.

Yet another object of the present invention is to provide two distal end arches having removable closure panels.

Still yet another object of the present invention is to provide a telescopic enclosure providing a plurality of sliding sections which slide on their own designated, respective track and slide over one another in order to enclose or expose a sun room or swim pool to the elements, each arch consisting of a plurality of wheels engaging the track members, transparent arch member positioned with a frame member, and a plurality of hook like terminations to prevent dislocation of the frame member from the track member.

Yet another object of the present invention is to provide track plugs that are inserted into each track rail.

Yet another object of the present invention is to provide an enclosure for swim pools and deck and patio areas.

Additional objects of the present invention will appear as the description proceeds.

The present invention overcomes the shortcomings of the prior art by providing a telescopic enclosure providing a plurality of sliding sections which slide on their own designated, respective track and slide over one another in order to enclose or expose a sun room or swim pool to the elements, each arch consisting of a plurality of wheels engaging the track members, transparent arch member positioned with a frame member, and a plurality of hook like terminations to prevent dislocation of the frame member from the track member. Also, to provide track plugs that are inserted into each track rail. Also to provide two distal end arches having removable closure panels.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claim

LIST OF REFERENCE NUMERALS

Figure 1:
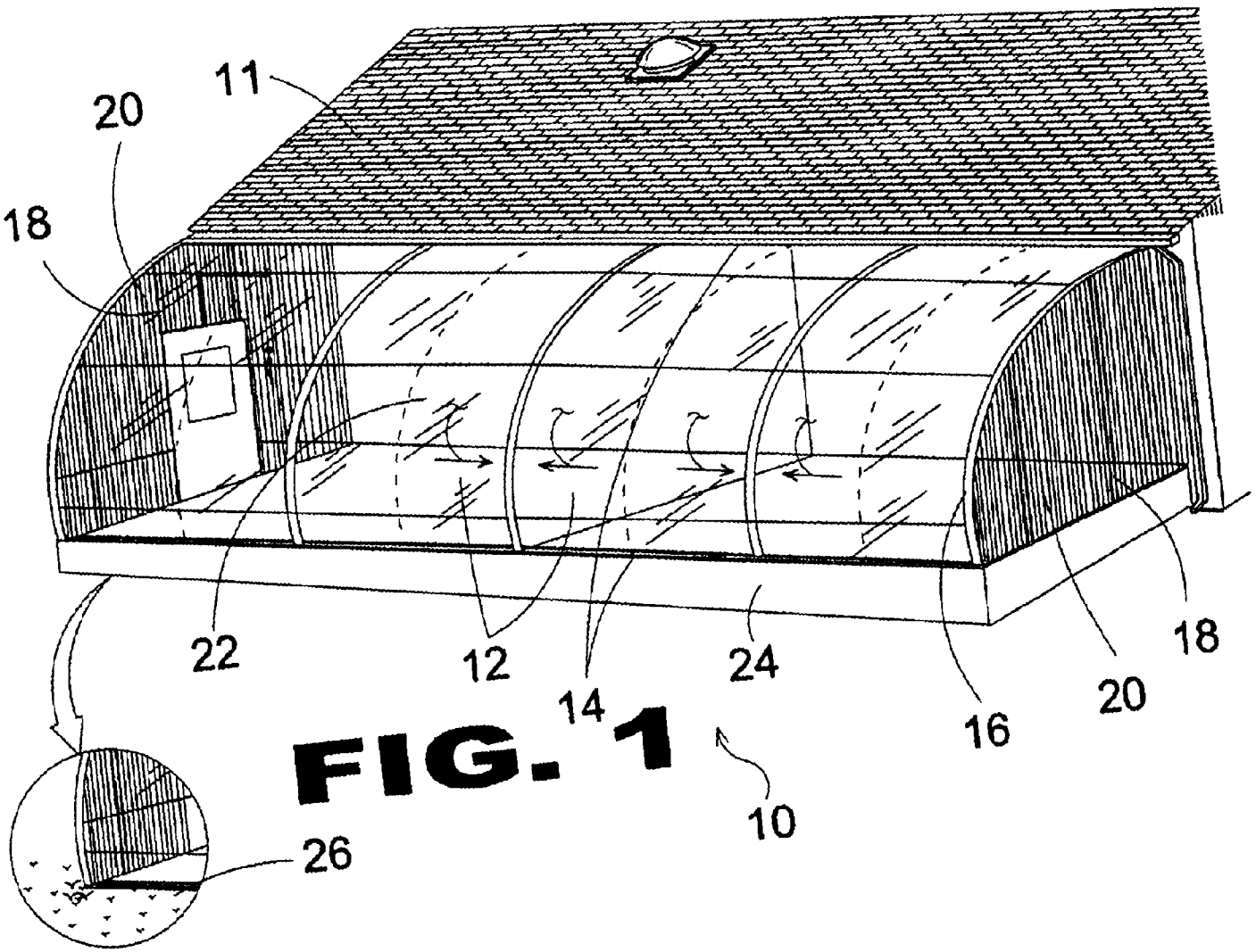
FIG. 1 is an illustrative view of the present invention showing sliding sections fully deployed. (Four Sections Shown)

With regard to reference numerals used, the following numbering is used throughout the drawings.

10 present invention
11 building
12 sliding sections
14 track
16 arcuate frame members
18 end frame members
20 end panels
22 transparent panel
24 pedestal
26 non-pedestal design
28 partially retracted section
30 partially retracted section
32 partially retracted section
34 non-retracted section
36 wheel
38 pool
40 anchor plate
42 U-shaped frame
44 horizontal frame member

46 track rail
50 base of track plate
52 slot
53 hook-like end
54 plastic end plug
56 plastic stop rod
58 foundation
60 rubber flap
62 additional track element
64 track cover
66 spacer
68 wind
70 hooks
72 straps
74 U-shaped receptacle
76 notch
78 edge of rail

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 disposed onto a proximate building 11 such as a residence showing multiple movable arcuate sections 12 fully deployed. Sections 12 comprise generally rectangular, planar, transparent panels 22 having two generally horizontal ends and two generally vertical sides. Four sections are shown in FIG. 1. The aqua shield telescopic sun room enclosure of the present invention 10 provides a plurality of rollable sections 12 which roll on their own designated, respective, horizontal tracks 14 and move laterally over one another in a telescoping fashion in order to enclose or expose a sun room to the elements. Also shown are the multiple arcuate support frame members 16 having a first and second end and a first and second side (See FIG. 19 for details) including a pair of end frame members 18 along with generally flat end panels 20. An alternative design 26 not having a pedestal 24 is also shown.

Figure 2:
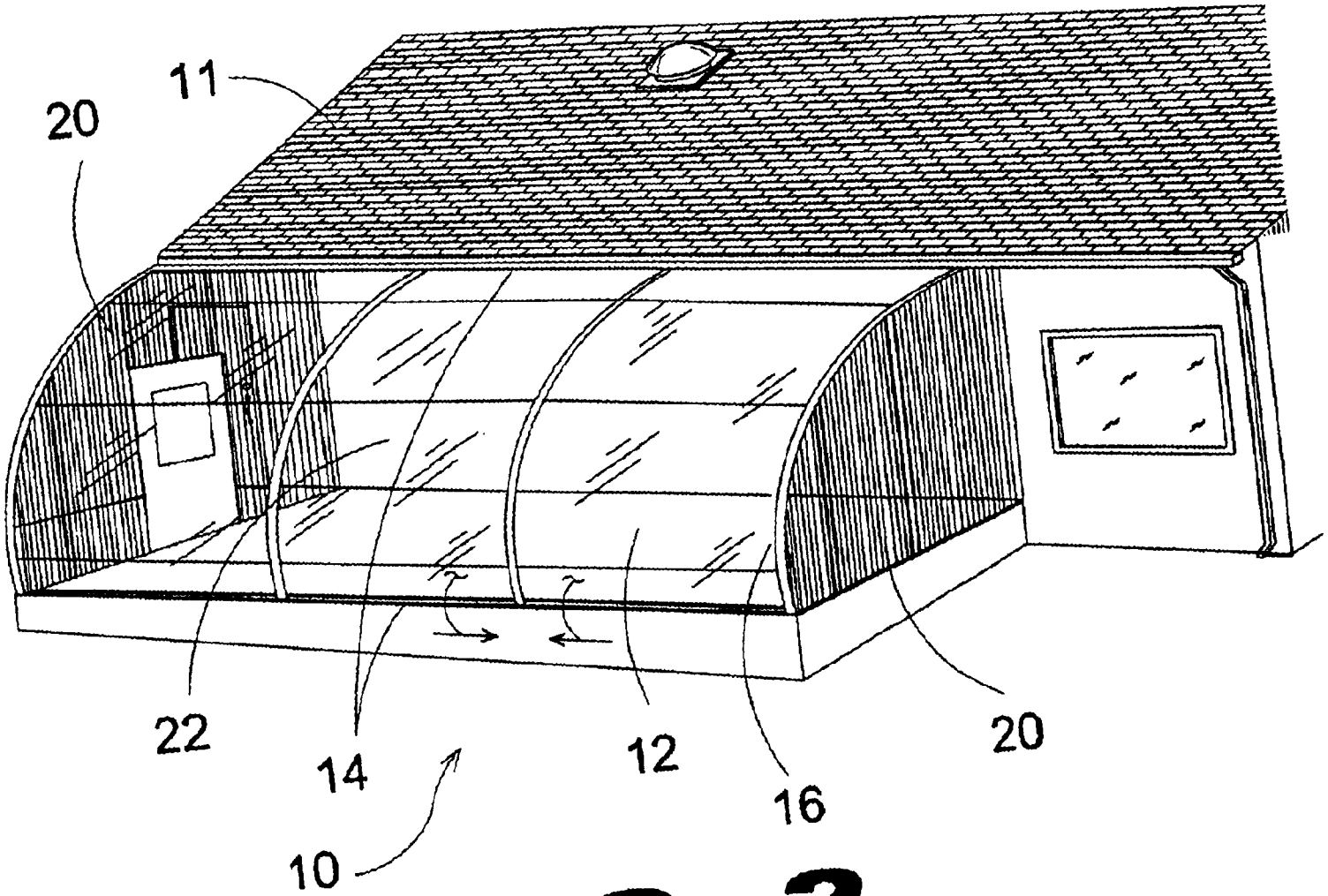
FIG. 2 is an illustrative view of the present invention showing sliding sections fully deployed. (Three Sections Shown)

Turning to FIG. 2, shown therein is an illustrative view of the present invention 10 showing sections 12 fully deployed. Three sections are shown in this view. The aqua shield telescopic sun room enclosure of the present invention 10 provides a plurality of sections 12 which move on their own designated, respective tracks 14 and move over one another in order to enclose or expose a sun room to the elements. Also shown are the frame members 16, end panels 20 and transparent panels 22.

Figure 3:
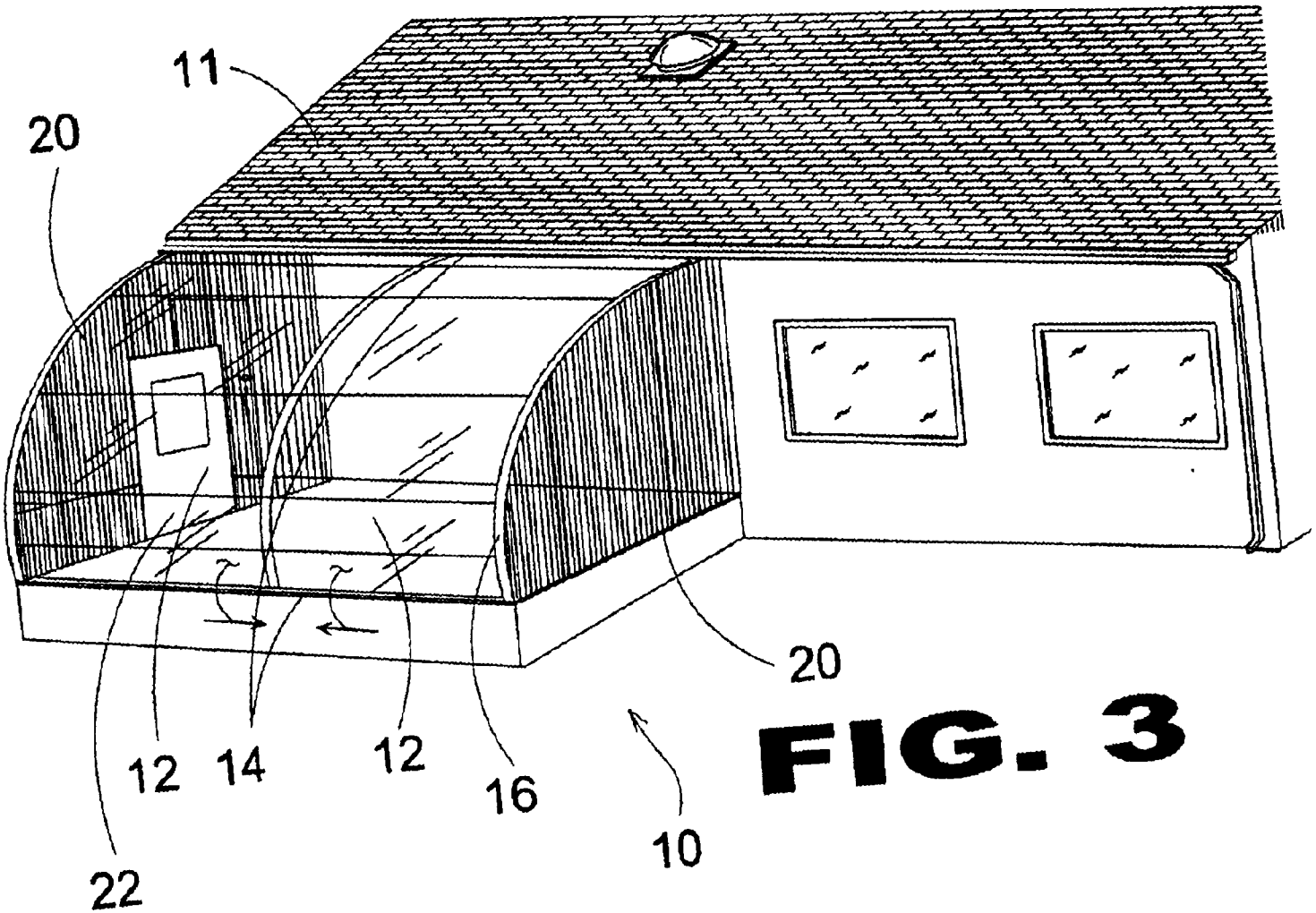
FIG. 3 is an illustrative view of the present invention showing sliding sections fully deployed. (Two Sections Shown)

Turning to FIG. 3, shown therein is an illustrative view of the present invention 10 showing sections 12 fully deployed. Two sections are shown in this view. The aqua shield telescopic sun room enclosure of the present invention 10 provides a plurality of sections 12 which move on their own designated, respective tracks 14 and move over one another in order to enclose or expose a sun room to the elements. Also shown are the frame members 16, end panels 20 and transparent panels 22.

Figure 4:
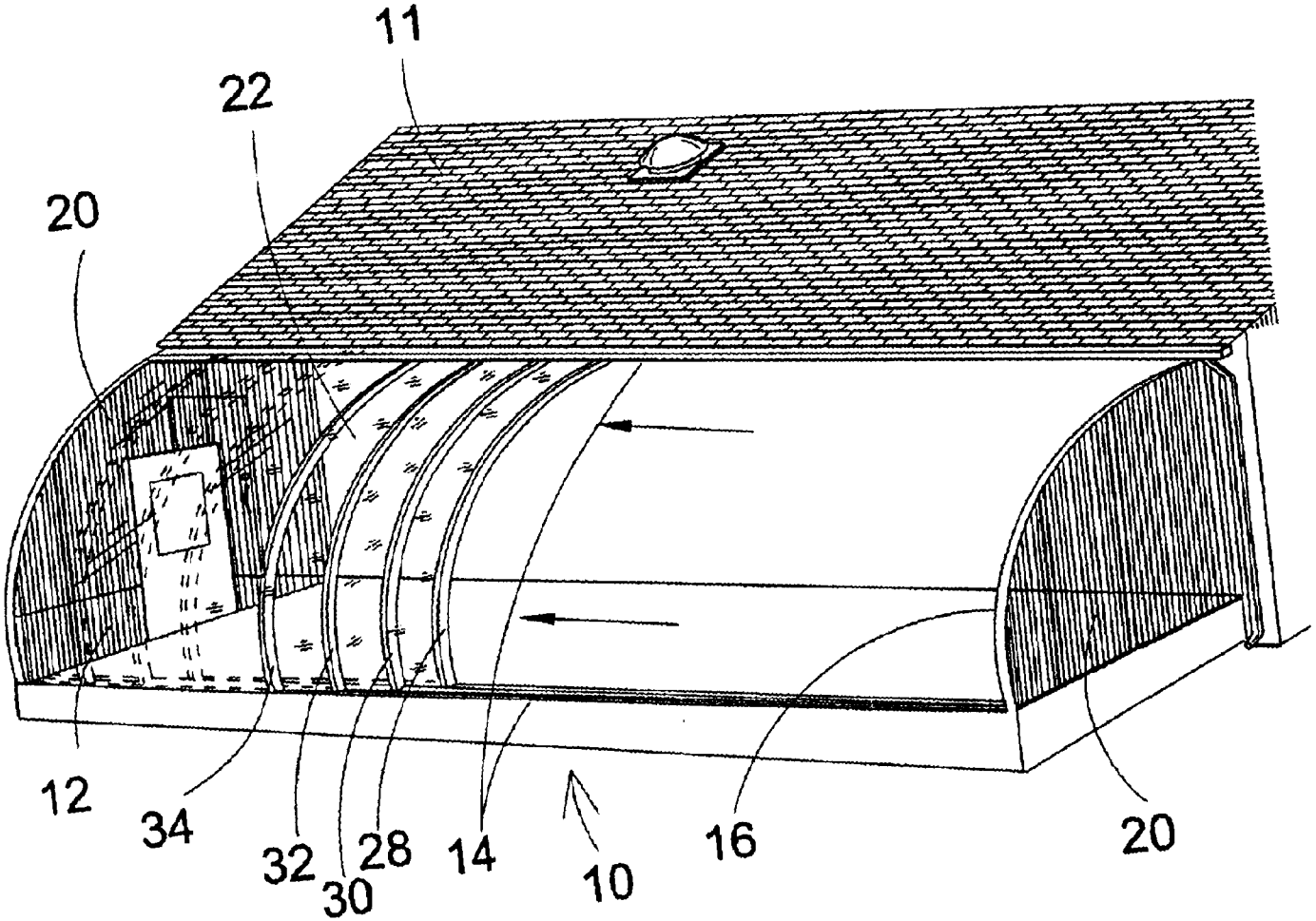
FIG. 4 is an illustrative view of the present invention showing sliding sections partially retracted or nested. (Four Sections Shown)

Turning to FIG. 4, shown therein is an illustrative view of the present invention 10 showing sections 12 partially retracted or nested. Four sections are shown in this view. The aqua shield telescopic sun room enclosure of the present invention 10 provides a plurality of sections 12 which move on their own designated, respective tracks 14 and move over one another in order to enclose or expose a sun room to the elements. Three sections 28, 30, 32 are shown partially retracted while a fourth section 34 is not retracted. Other elements previously disclosed are also shown.

Figure 5:
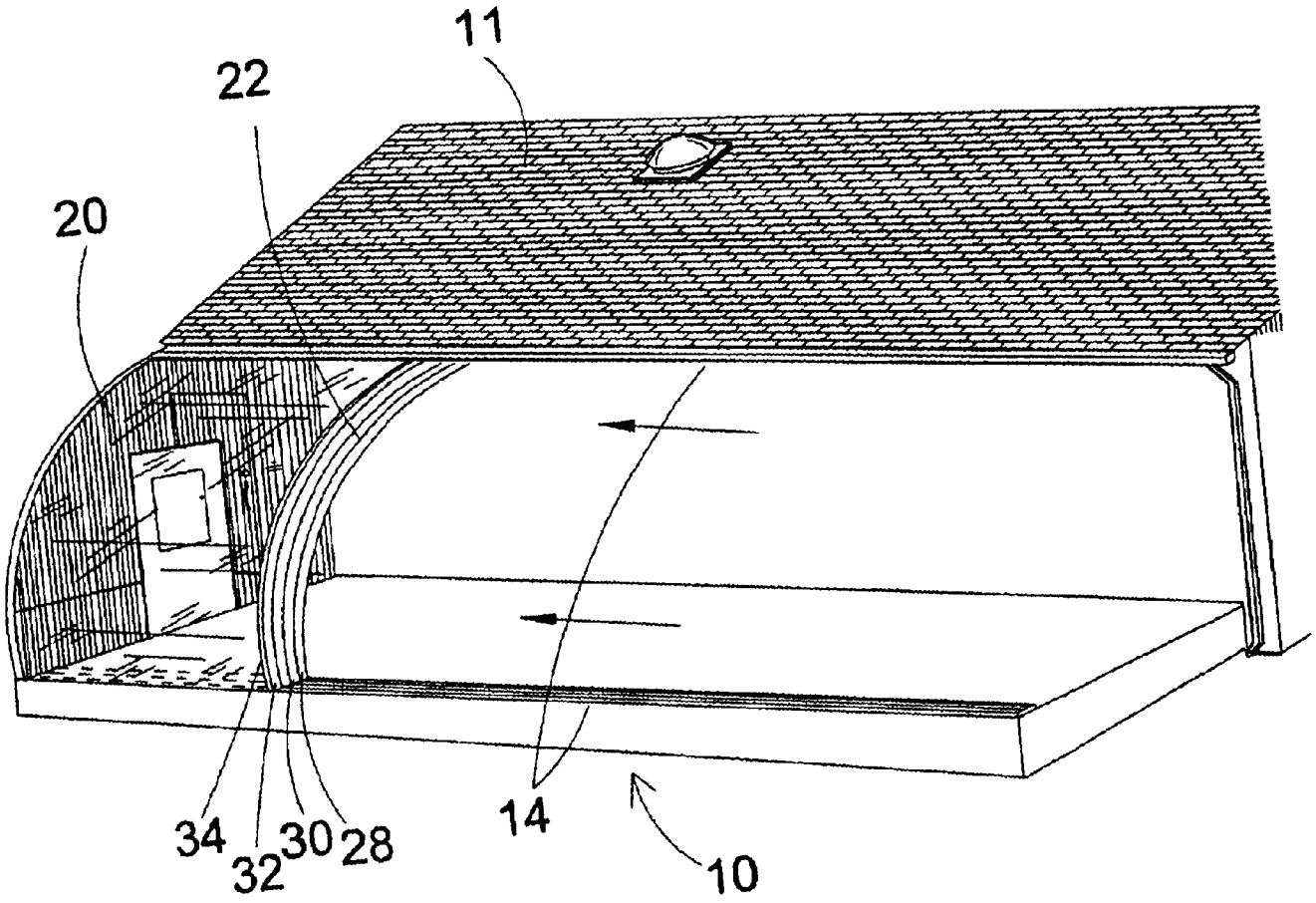
FIG. 5 is an illustrative view of the present invention showing sliding sections fully retracted or nested. (Four Sections Shown)

Turning to FIG. 5, shown therein is an illustrative view of the present invention 10 showing sections 28, 30, 32, 34 fully retracted or nested. Four sections are shown in this view being disposed so that those with smaller diameters are placed inward of those with larger diameters so that they can telescope. The aqua shield telescopic sun room enclosure of the present invention 10 provides a plurality of sections 28, 30, 32, 34 which move on their own designated, respective tracks 14 and move over one another in order to enclose or expose a sun room to the elements. Other elements previously disclosed are also shown.

Figure 6:
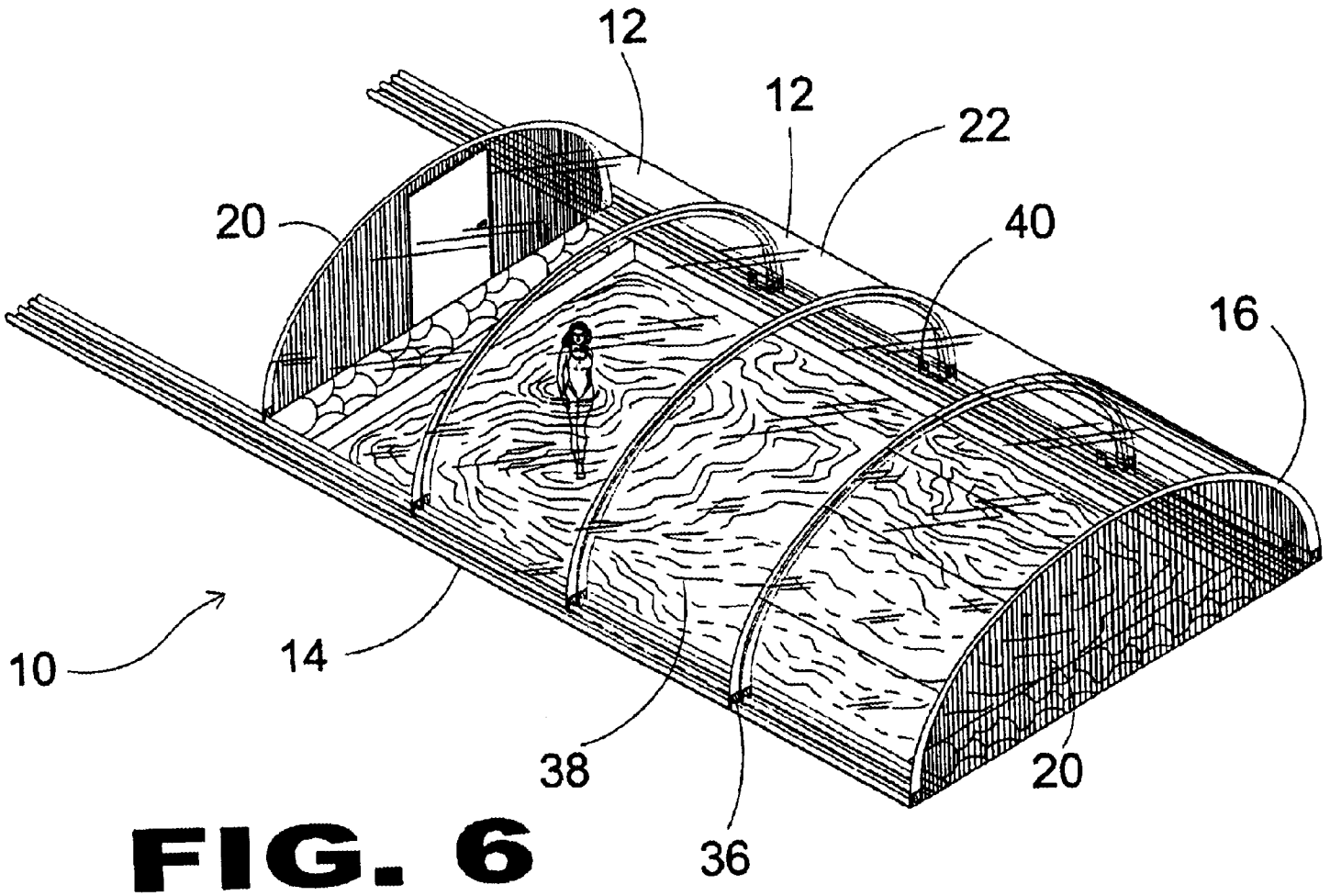
FIG. 6 is an illustrative view of the present invention showing sliding sections fully deployed. (Four Sections Shown)

Turning to FIG. 6, shown therein is an illustrative view of the present invention 10 showing sections 12 fully deployed over a swimming pool 38. Four sections are shown in this view. The aqua shield of the present invention 10 is comprised of a plurality of overlapping arcuate arches or sections 12 positioned on parallel tracks 14. The arches 12 can be selectively moved to any position on the track 14. The two distal end arches have removable end closure panels 20. Each of the arches has a plurality of wheels 36 engaging track members 14. Also shown are the frame members 16, transparent panels 22 and anchor plates 40.

Figure 7:
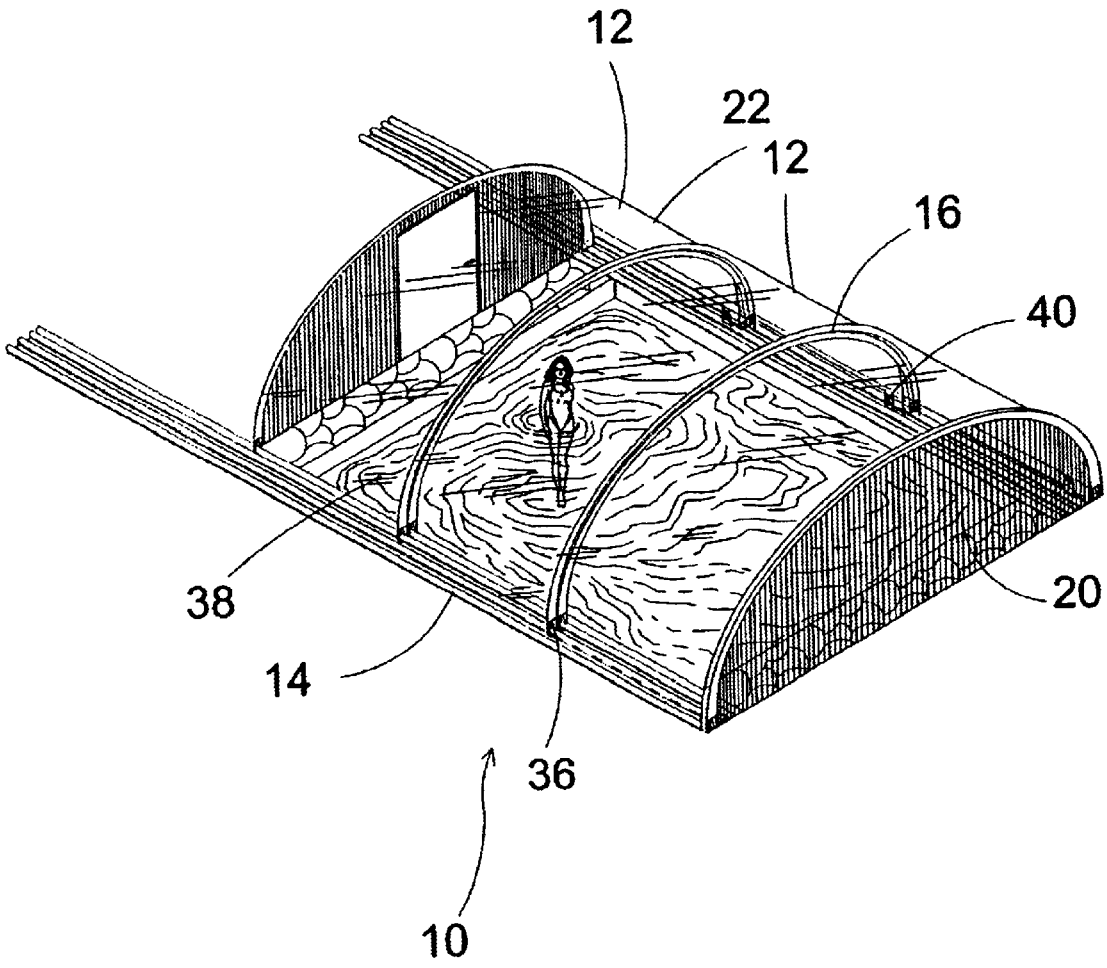
FIG. 7 is an illustrative view of the present invention showing sliding sections fully deployed. (Three Sections Shown)

Turning to FIG. 7, shown therein is an illustrative view of the present invention 10 showing sections 12 fully deployed. Three sections are shown in this view. The present invention 10 is comprised of a plurality of overlapping arches 12 positioned on parallel tracks 14. The arches 12 can be selectively moved to any position on the track 14. The two distal end arches have removable closure panels 20. Each of the arches has a plurality of wheels 36 engaging track members 14. Other elements previously disclosed are also shown.

Figure 8:
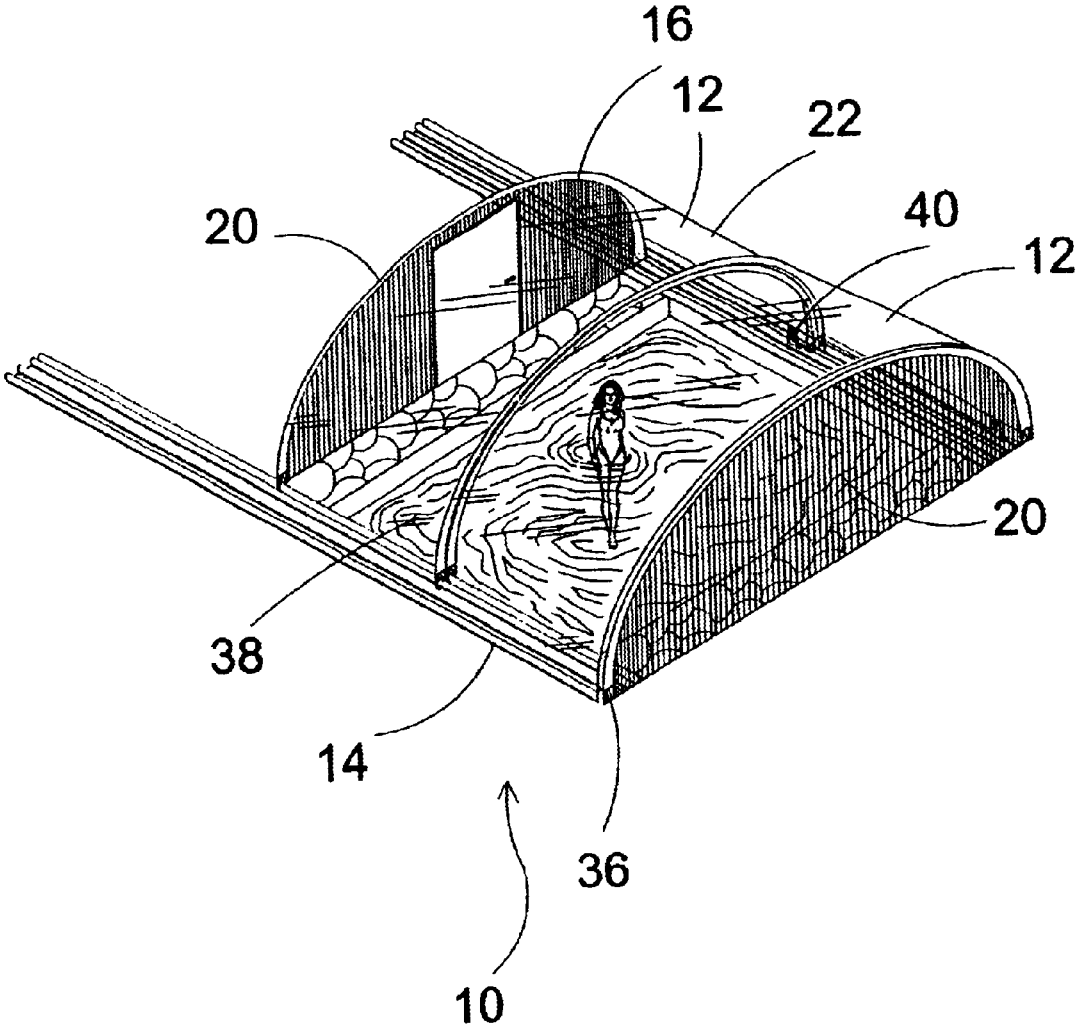
FIG. 8 is an illustrative view of the present invention showing sliding sections fully deployed. (Two Sections Shown)

Turning to FIG. 8, shown therein is an illustrative view of the present invention 10 showing sections fully deployed. Two sections are shown. The present invention 10 is comprised of a plurality of overlapping arches 12 positioned on parallel tracks 14. The arches 12 can be selectively moved to any position on the track 14. The two distal end arches have removable closure panels 20. Each of the arches has a plurality of wheels 36 engaging track members 14. Other elements previously disclosed are also shown.

Figure 9:
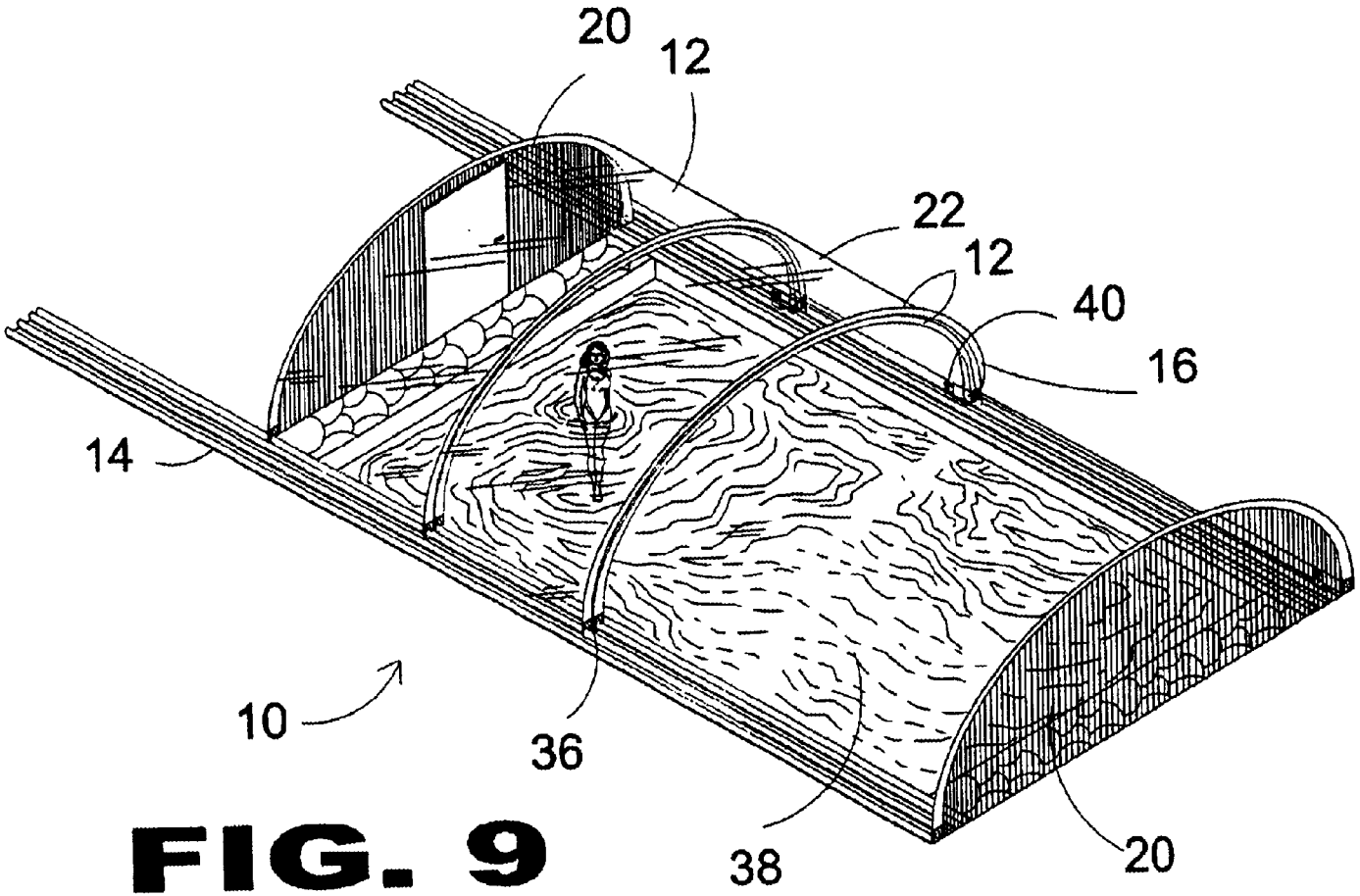
FIG. 9 is an illustrative view of the present invention showing sliding sections partially nested. (Four Sections Shown)

Turning to FIG. 9, shown therein is an illustrative view of the present invention 10 showing sections 12 partially nested. Three sections are shown. The present invention 10 is comprised of a plurality of overlapping arches 12 positioned on parallel tracks 14. The arches 12 can be selectively moved to any position on the track 14. The two distal end arches have removable closure panels 20. Each of the arches 12 has a plurality of wheels 36 engaging track members 14. Other elements previously disclosed are also shown.

Figure 10:
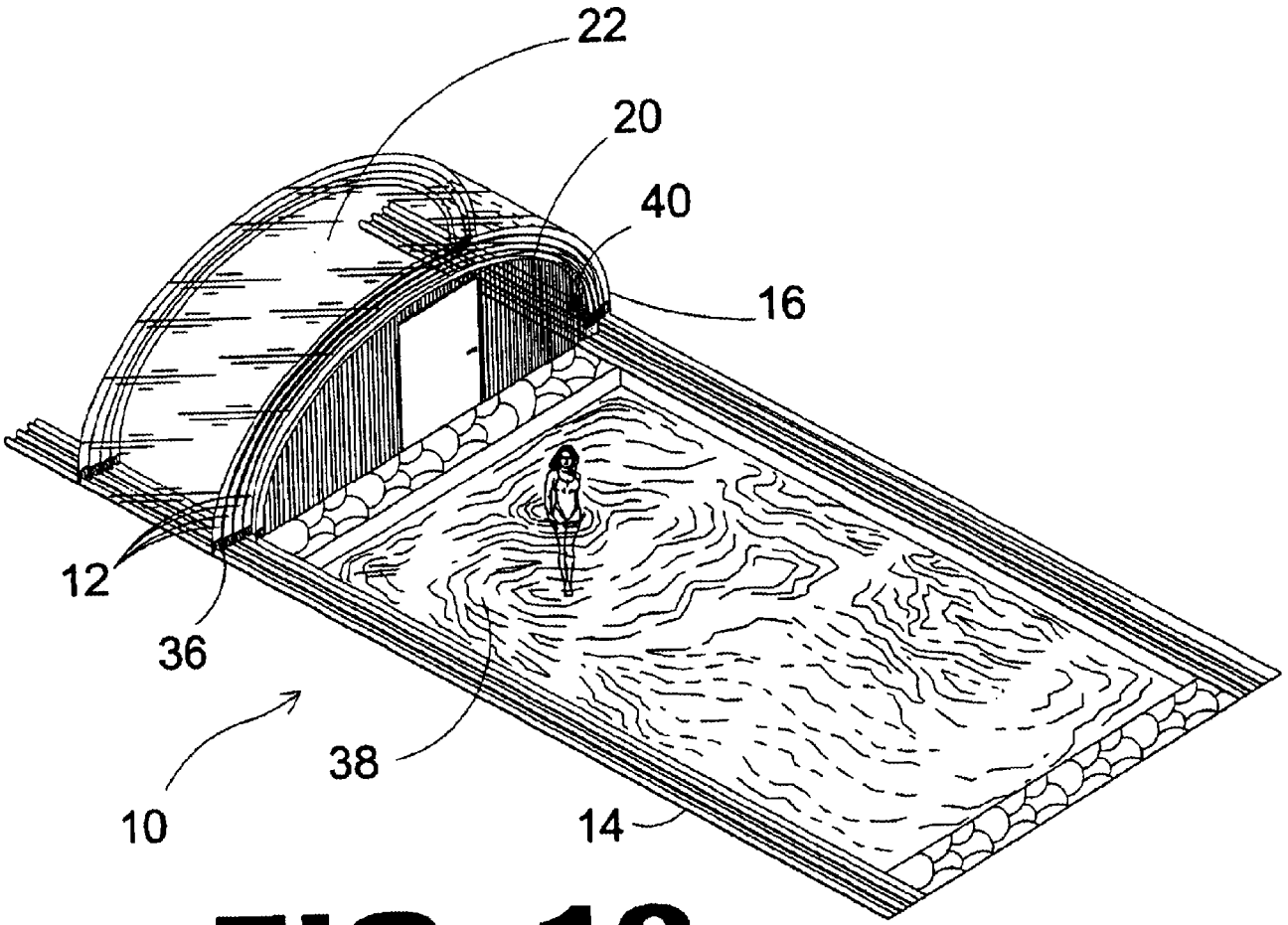
FIG. 10 is an illustrative view of the present invention showing sliding sections fully nested. (Four Sections Shown)

Turning to FIG. 10, shown therein is an illustrative view of the present invention 10 showing sections 12 fully nested. Four Sections are shown. The present invention 10 is comprised of a plurality of overlapping arches 12 positioned on parallel tracks 14. The arches 12 can be selectively moved to any position on the track 14. The two distal end arches have removable closure panels 20. Each of the arches 12 has a plurality of wheels 36 engaging track members 14. Other elements previously disclosed are also shown.

Figure 11:
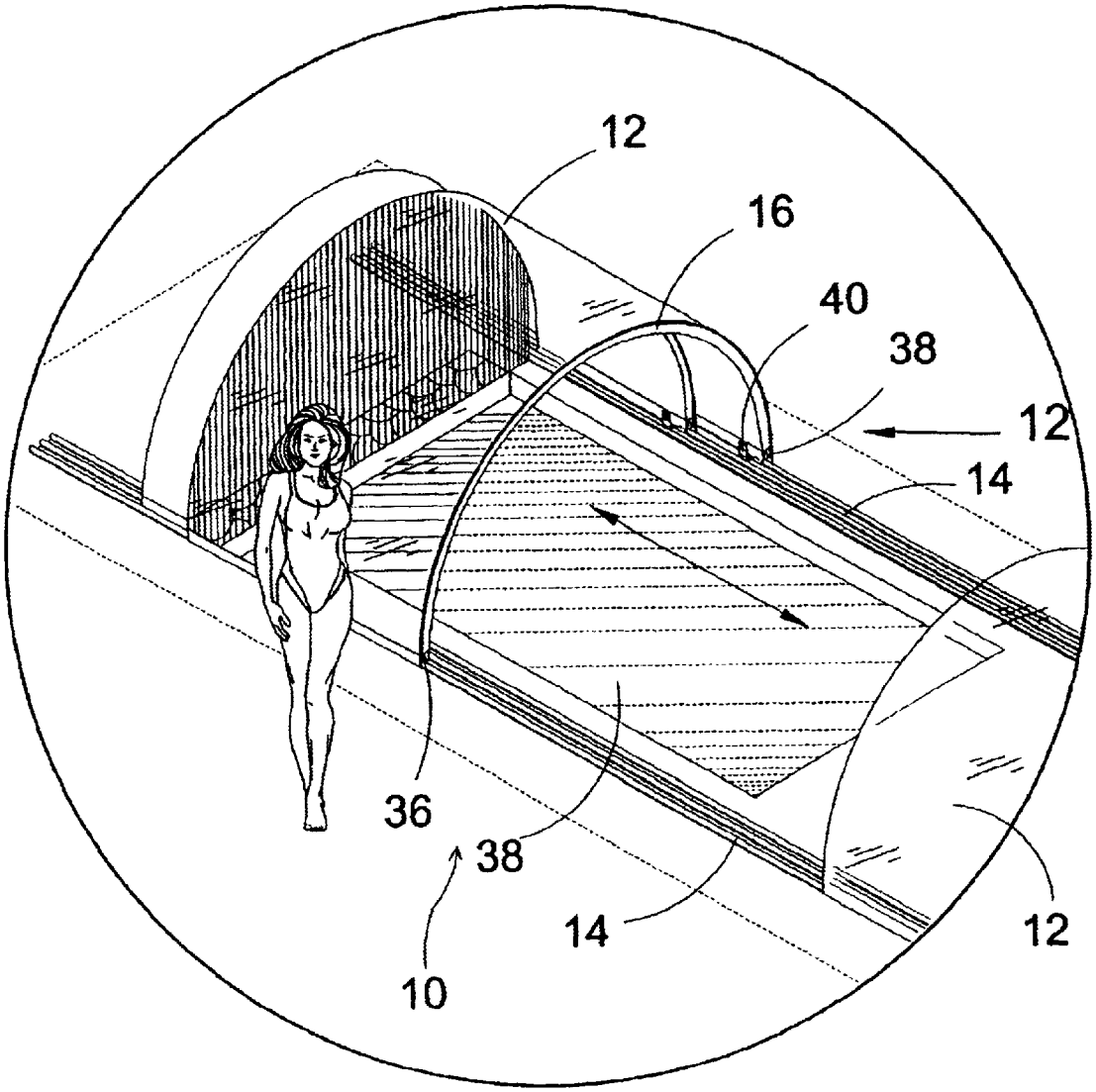
FIG. 11 is an illustrative view of the present invention in an alternate glazing shape.

Turning to FIG. 11, shown therein is an illustrative view of the present invention 10 in an alternate, half circle-like shape. Also shown elsewhere are the one-fourth of an ellipse shape of FIG. 1 and the half of an ellipse shape of FIG. 6. The present invention 10 is comprised of a plurality of overlapping arches 12 positioned on parallel tracks 14. The arches 12 can be selectively moved to any position on the track 14. The two distal end arches have removable closure panels 20. Each of the arches has a plurality of wheels 36 engaging track members 14. Other elements previously disclosed are also shown.

Figure 12:
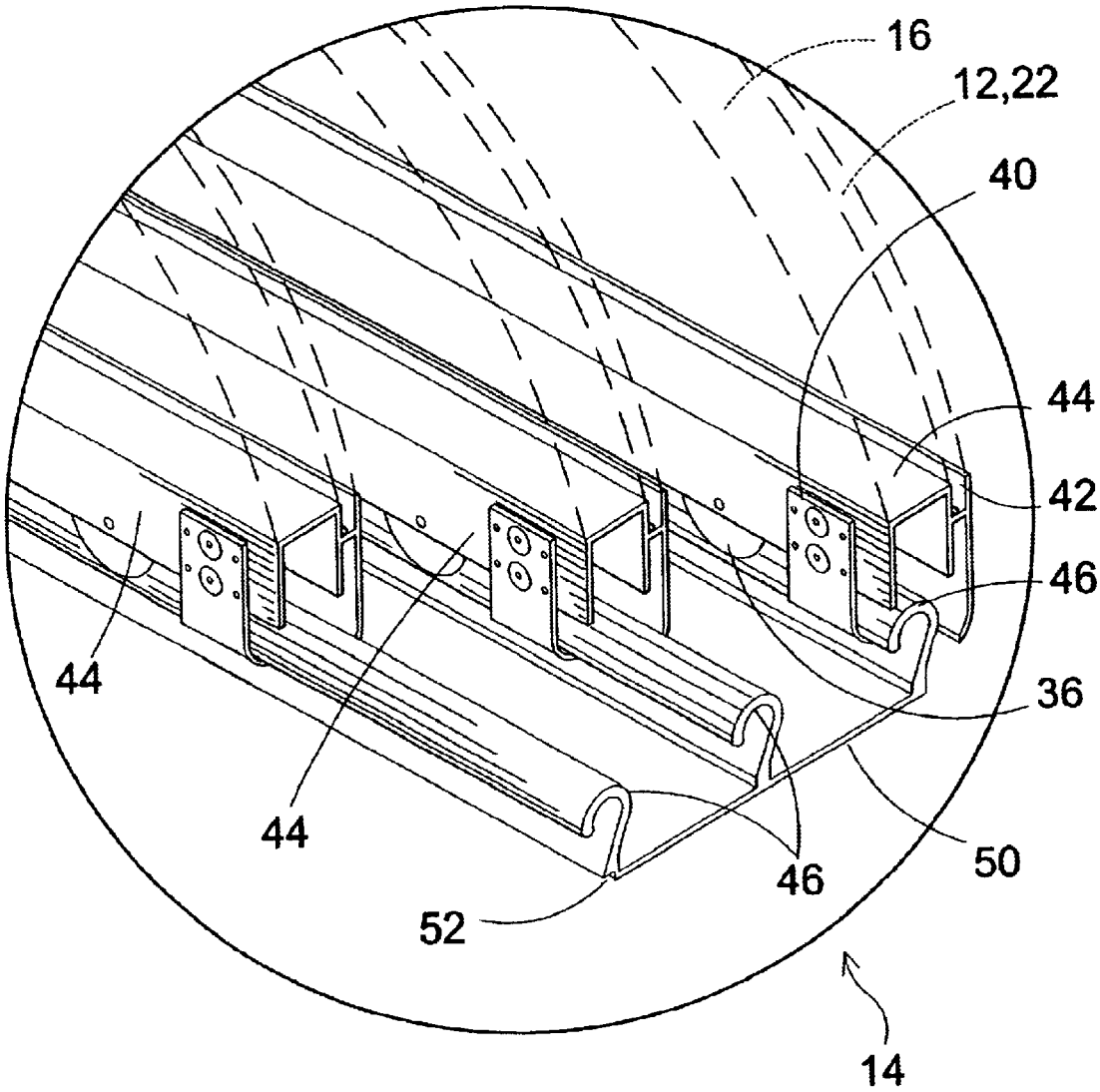
FIG. 12 is a detail view of the track and bottom portion of the frame of the present invention.

Turning to FIG. 12, shown therein is a detail view of the track 14 and bottom portion of the frame 16 of the present invention. Each of the two ends of each transparent panels 22 of section 22 are disposed within an upright standing U-shaped frame member 42 and each horizontal frame member 44 has a plurality of wheels 36 engaging spaced apart track rail members 46 using anchor plate 40. Three separate horizontal frame member units 44 are shown along with the track plate base 50 having a slot 52 for receiving additional tracks.

Figure 13:
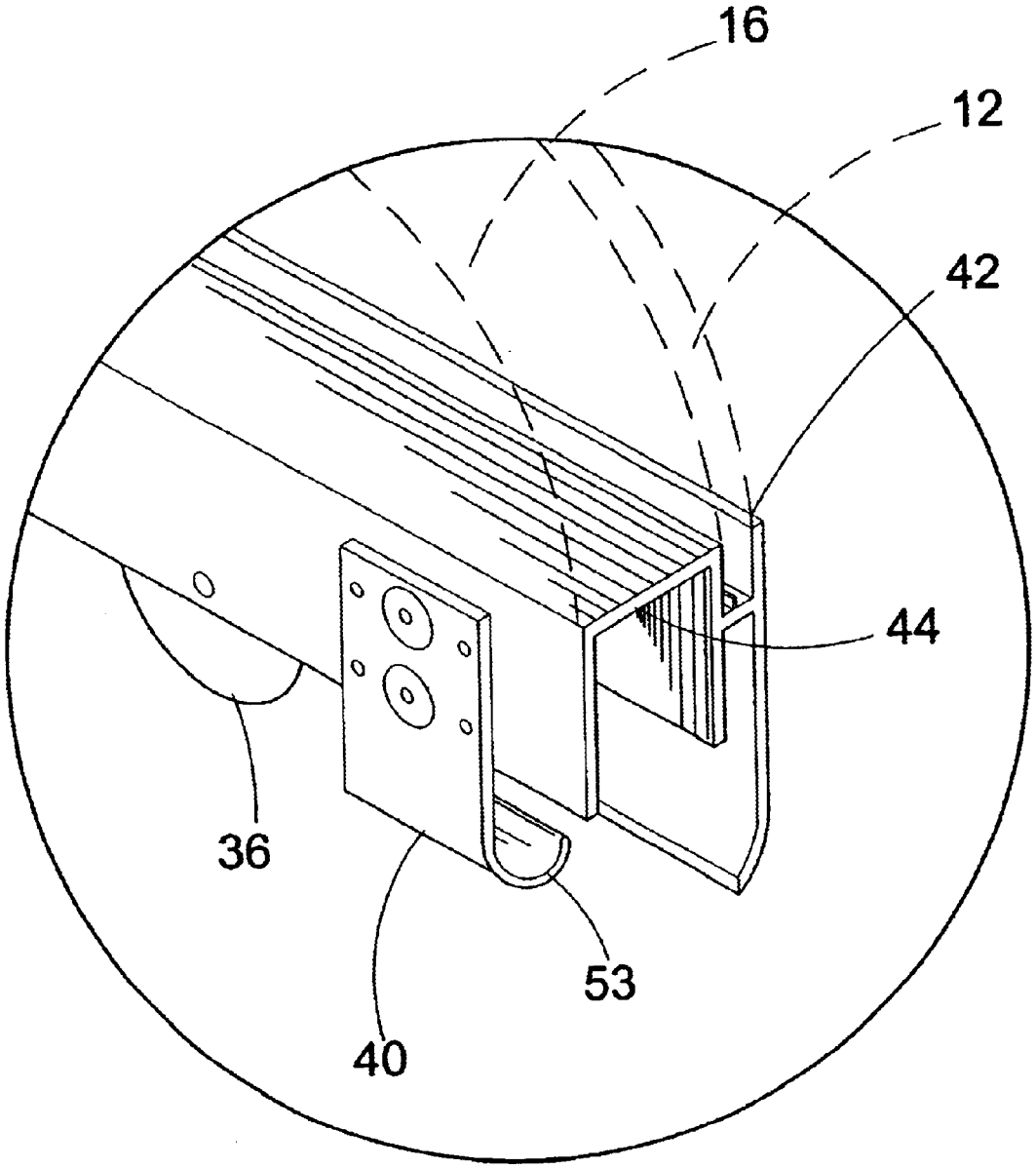
FIG. 13 a detail view of the bottom portion of the frame of the present invention.

Turning to FIG. 13, shown therein is a detailed view of the bottom portion of the frame 16 of the present invention. Each side of an arch 12 consists of a plurality of wheels 36 fixedly disposed within a downwardly disposed U-shaped frame element 44 having a downwardly extending anchor plate 40 with hook-like lower end terminations 53 to prevent dislocation of the frame member 44 from the track rail 46(not shown). Also shown is the upwardly disposed U-shaped frame 42 which receives the lower end of section 12.

Figure 14:
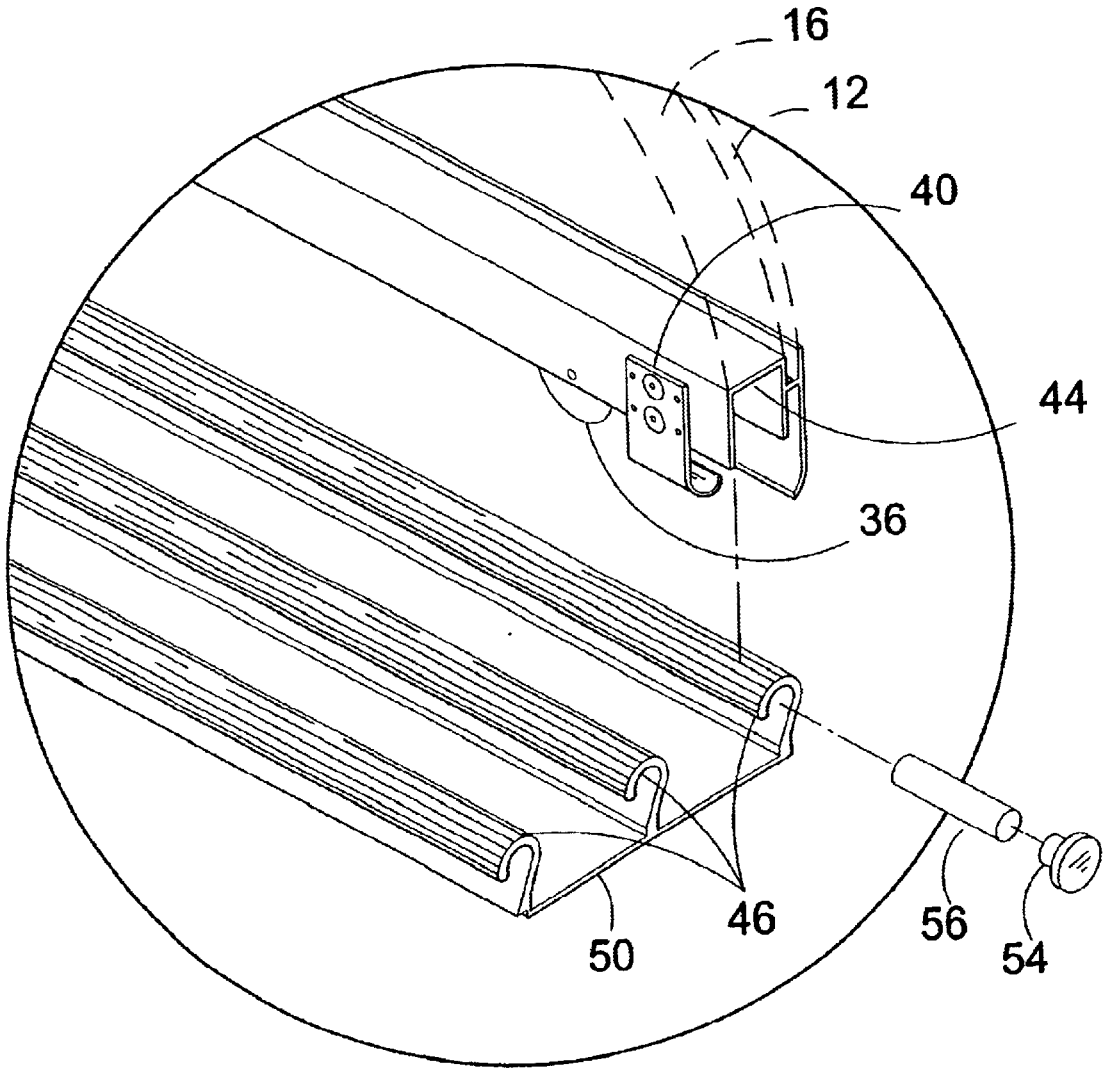
FIG. 14 is a detail view of the lower portion of the enclosure of the present invention.

Turning to FIG. 14, shown therein is a detail view of the lower portion of the enclosure of the present invention. Track member rails 46 are fixedly positioned to the ground or foundation structures in a spaced apart parallel configuration. Each arch 12 is slidably positioned on its respective frame member 44 and track rail 46 before a plastic end plug 54 and a plastic stop rod 56 are inserted into the ends of each track rail 46. Other elements previously disclosed are also shown.

Figure 15:
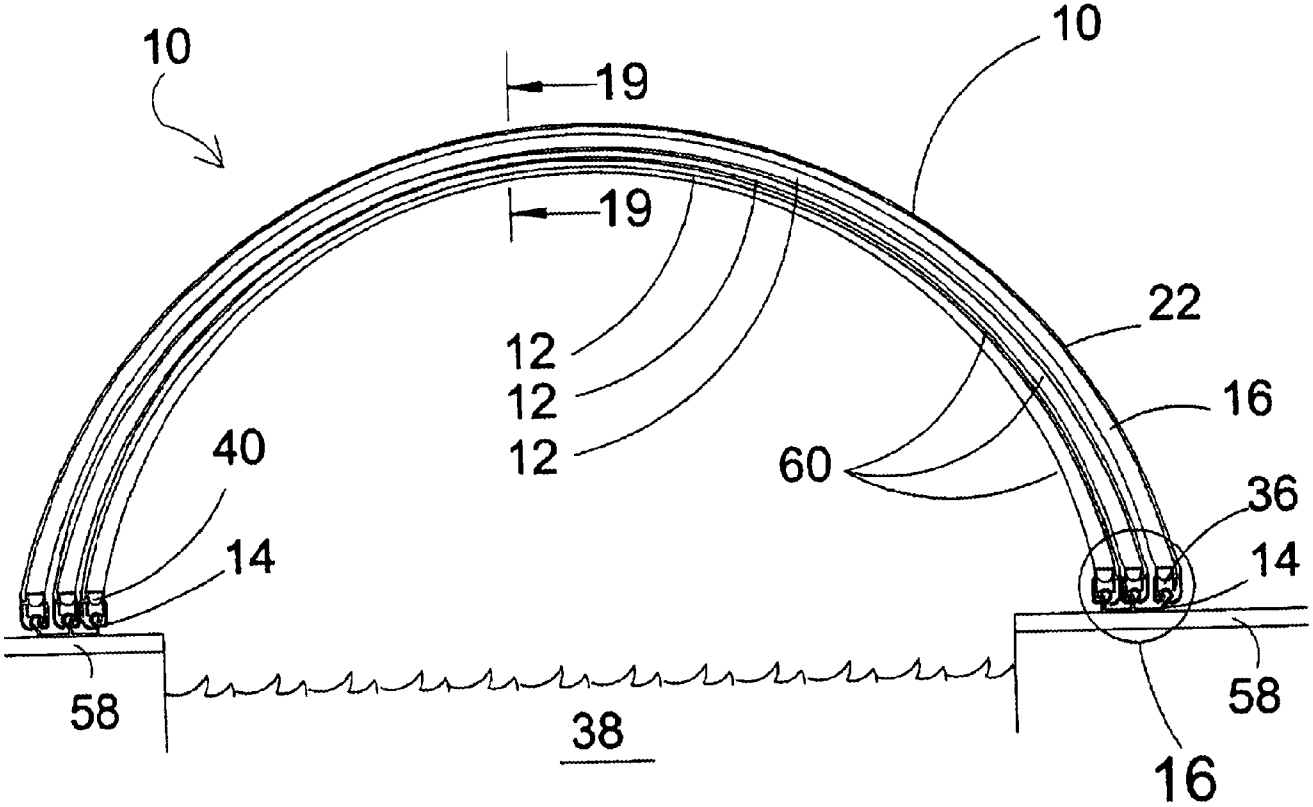
FIG. 15 is a front view of the present invention.

Turning to FIG. 15, shown therein is a front view of the present invention 10. The two tracks 14 are mounted to a flat foundation 58, on parallel and opposite sides of a swimming pool 38. Plastic plugs 54 (not shown) are placed in the end of the track after the sections are in place. Each section 12 is placed into the track, beginning with the one with the smallest diameter on the interior. An unlimited amount of enclosure sections 12 can be assembled. Each section 12 moves independently from the others by opening and closing telescopically. Also shown are inwardly extending rubber flaps 60 along with other elements previously disclosed.

Figure 16:
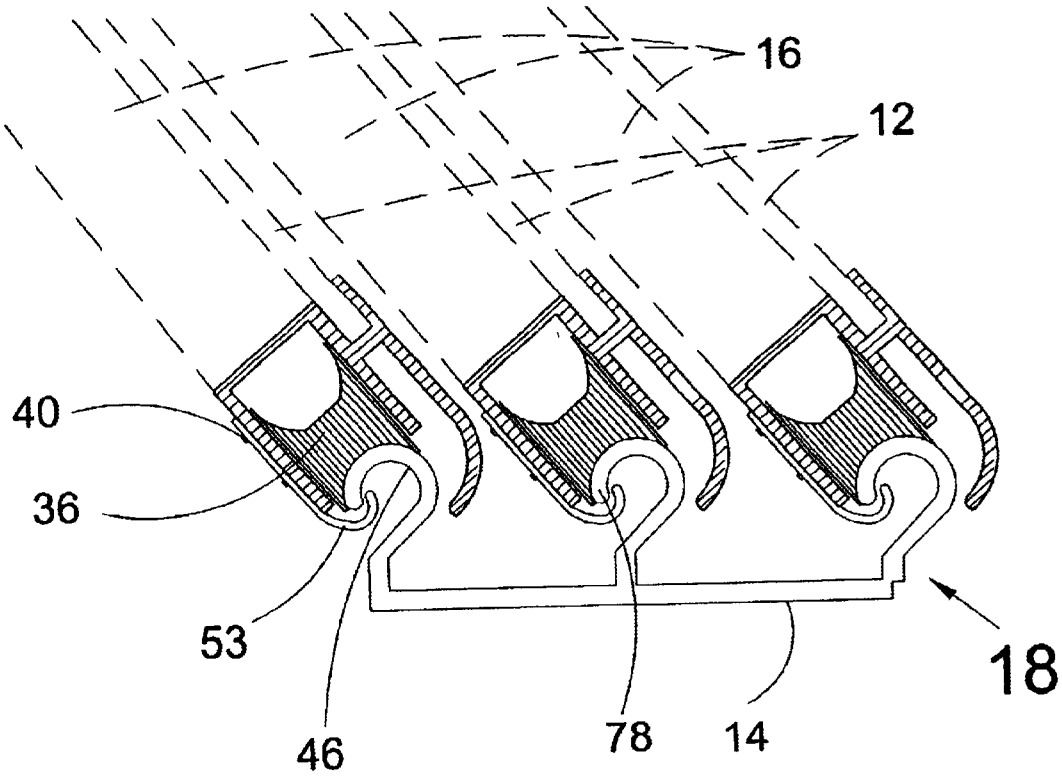
FIG. 16 is a sectional view of the lower portion of the present invention.

Turning to FIG. 16, shown therein is a sectional view of the lower portion of the present invention. Shown are the moving parts that comprise the device of the present invention. The rails 46 of the track 14 are designed so that the mating wheels 36 can ride upon them at angles agreeable or complementary to the angle of the bottom portion of the enclosure. Hooks 53 overlap the enlarged, exposed edge 78 of the rail 46 to secure the anchor plate 40 thereto. Other elements previously disclosed are also shown.

Figure 17:
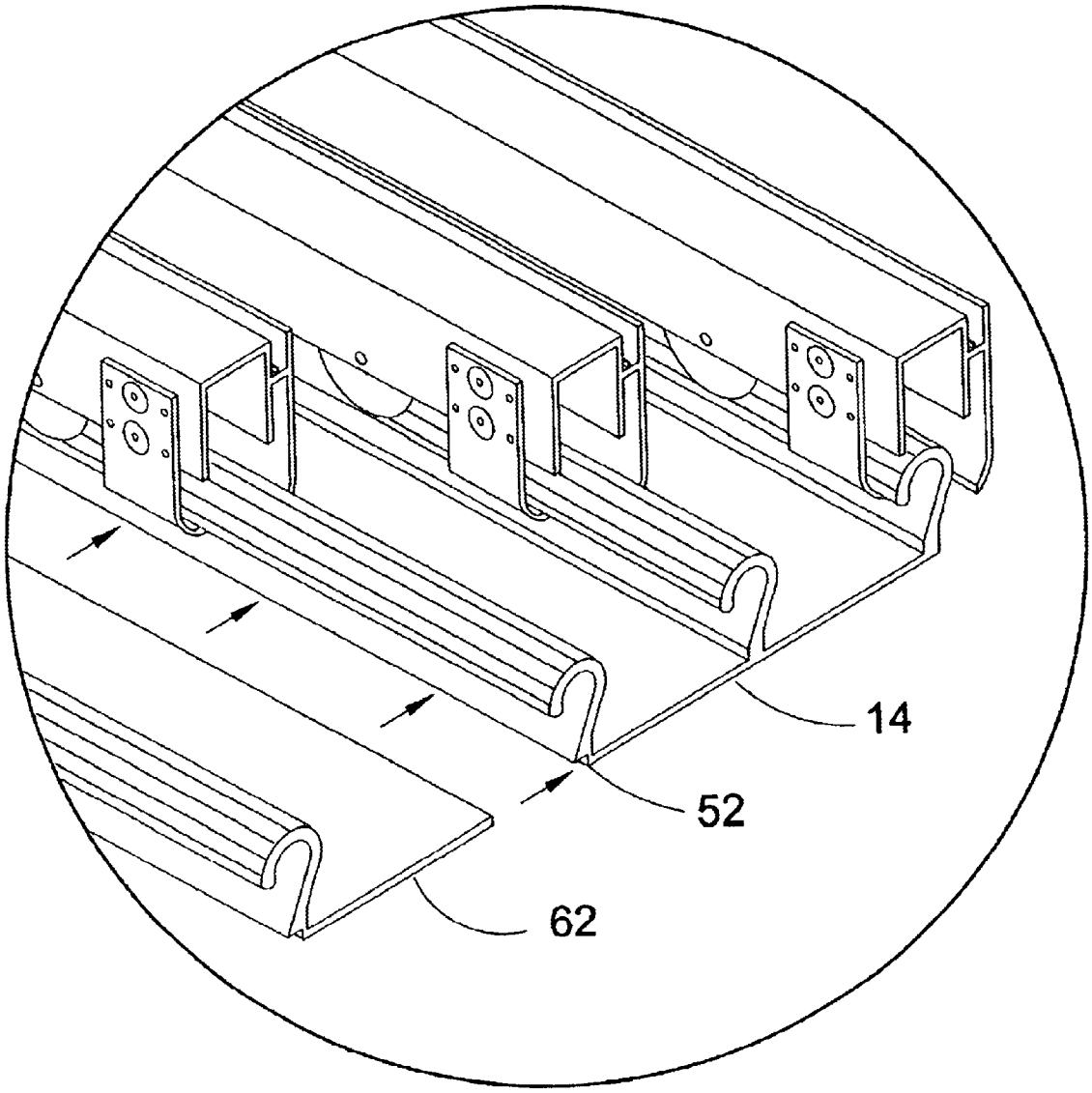
FIG. 17 is a detail perspective view of the lower portion of the present invention.

Turning to FIG. 17, shown therein is a detail perspective view of the lower portion of the present invention. Additional track elements 62 can be added to the main track 14 to provide additional enclosure units by placing the edge of track element 62 into slot 52 located on the edge of the track base.

Figure 18:
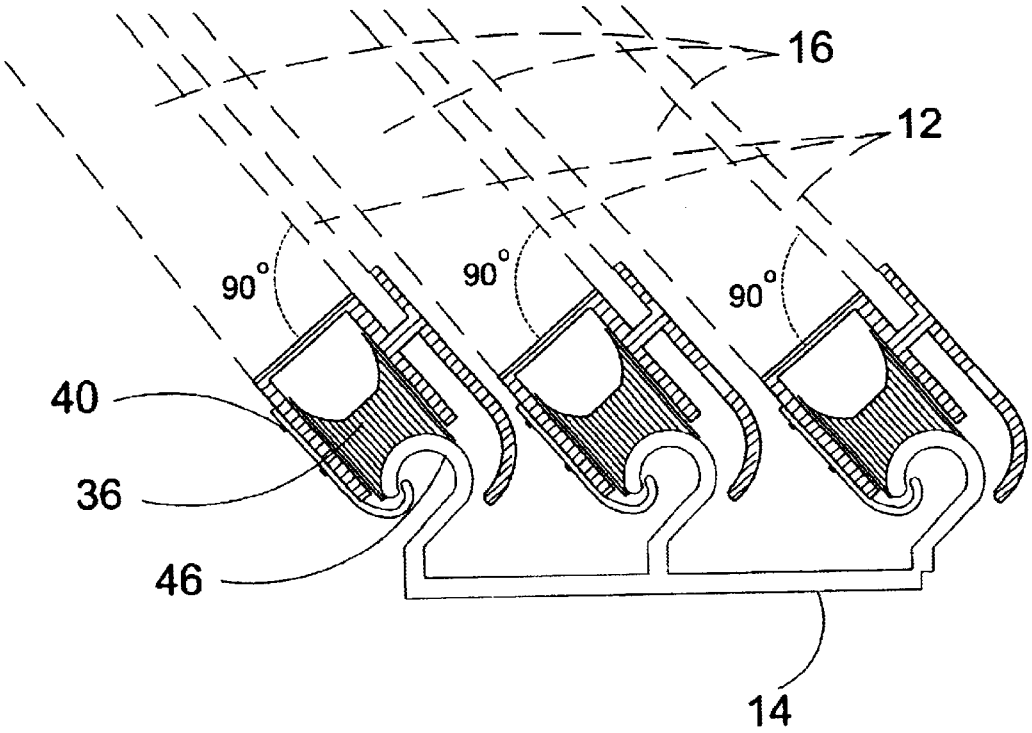
FIG. 18 is a sectional view of the lower portion of the present invention.

Turning to FIG. 18, shown therein is a sectional view of the lower portion of the present invention. The arches 12 are designed so that the transparent panel elements are fixedly positioned within the track 14 engaging frame 16 in a coplanar and 90-degree or perpendicular relationship. Thereby the entire width of the arch is supported by the track. Other elements previously disclosed are also shown.

Figure 19:
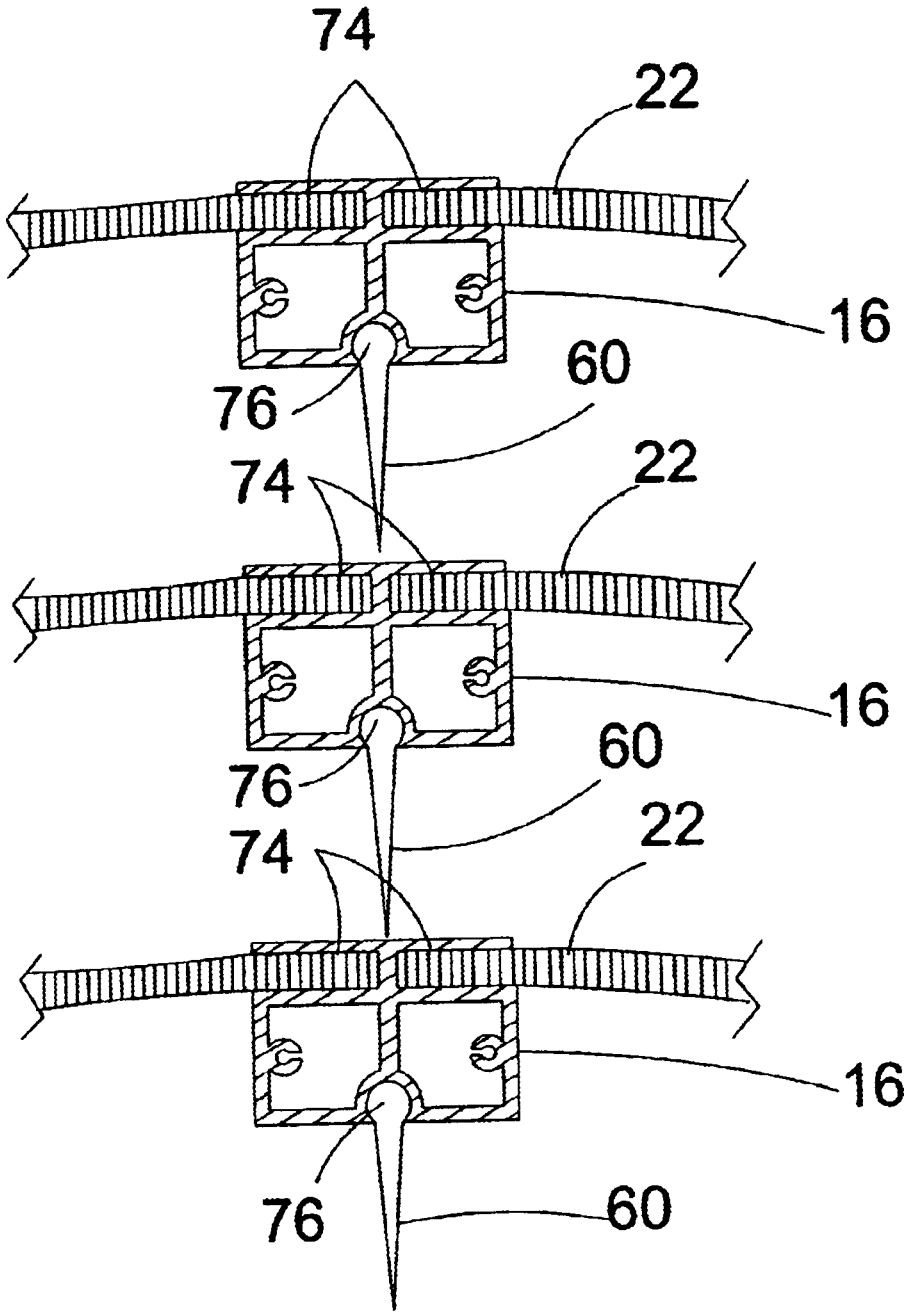
FIG. 19 is a cross sectional view of the present invention.

Turning to FIG. 19, shown therein is a cross sectional view of the present invention. Shown are three enclosure units taken from FIG. 16 including the rectangular frame housing 16, transparent panel 22 and rubber gaskets or flap 60. The housing of frame 16 has a pair of horizontally opposed U-shaped receptacles 74 on its two sides and on its outer surface for receiving the edges of the panels 22. A slot or notch 76 is provided on the inner surface of frame housing 16 for receiving the flap 60.

Figure 20:
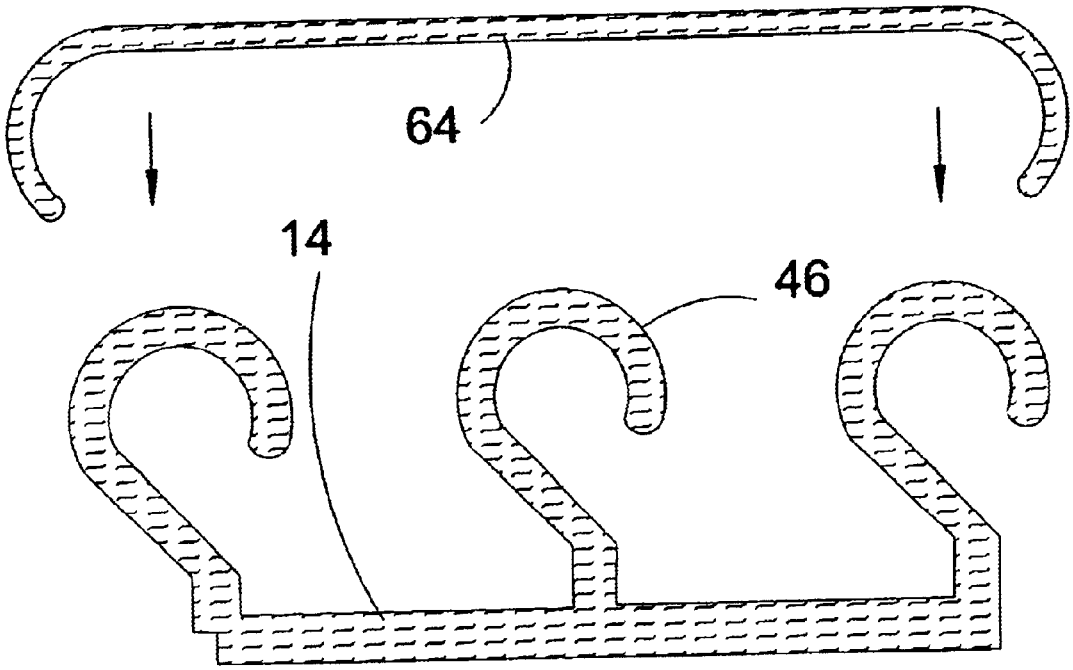
FIG. 20 is a front view of track and cover plate of the present invention.
Figure 20:
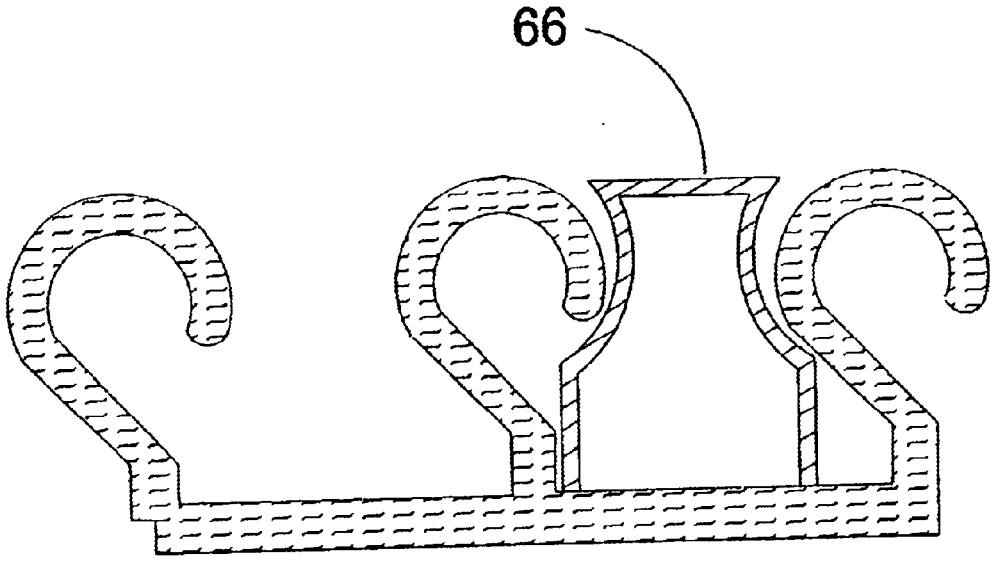

Turning to FIG. 20, shown therein is a front view of track 14 and the plastic track cover plate 64 of the present invention. The unused portion of the track 14 and rail 46 can be covered over with a cover plate 64. The cover plate 64 smoothes off the top portion of the track 14 so as to prevent hurting one's feet when stepping on the track. A plastic track cover spacer 66 is also shown to provide additional support to the cover plate 64 and rails 46.

Figure 21:
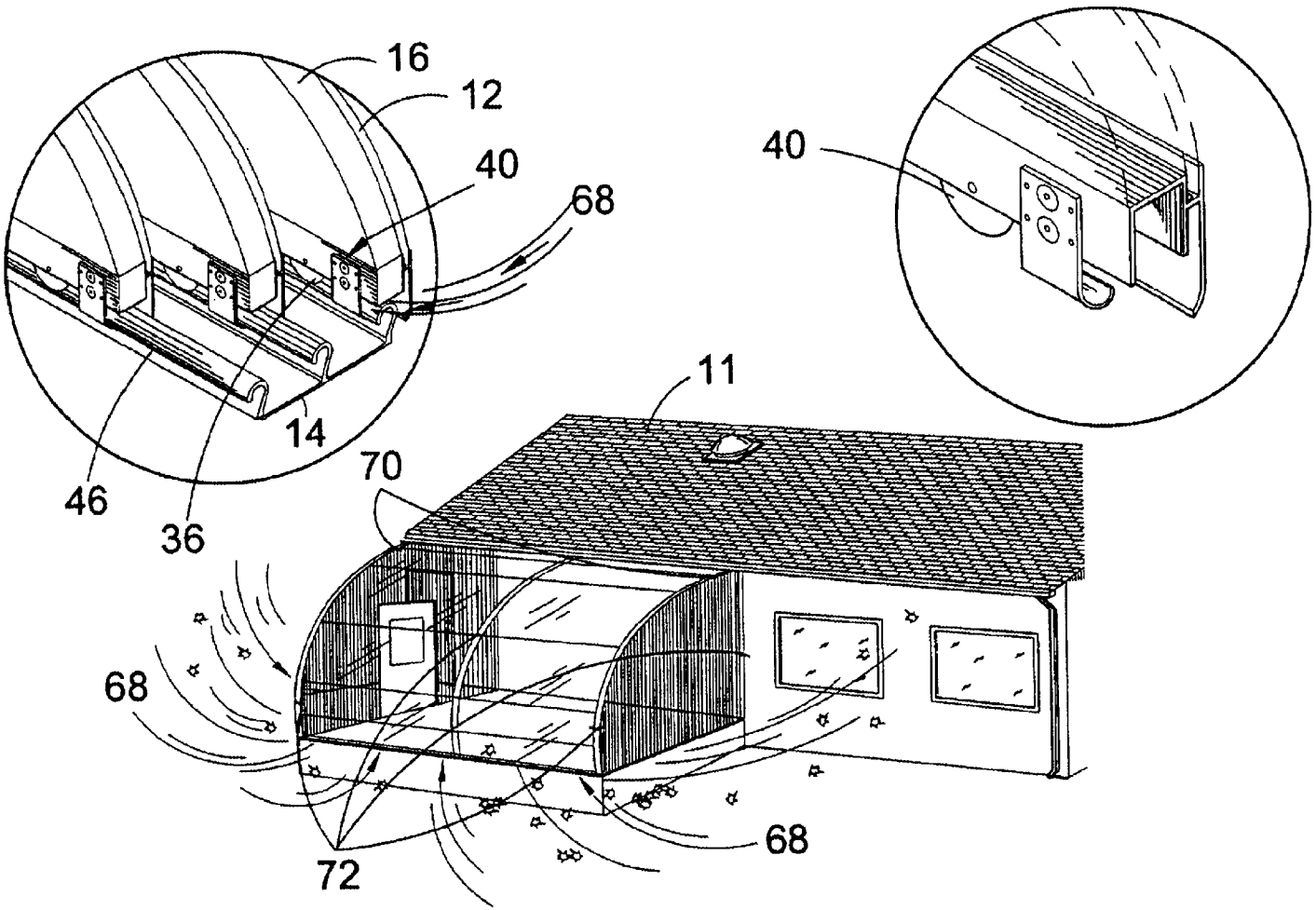
FIG. 21 is a detail view of the track and bottom portion of the frame of the present invention in a wind condition.

Turning to FIG. 21, shown therein is a detail view of the track 14 and bottom portion of the frame 16 of the present invention in a wind condition. The anchor plate 40 is attached to the lower portion of the frame 16 and secures the dome sections 12 to the track so the dome sections 12 can roll and hold simultaneously. This design provides a secured relationship between the track 14 and the dome section 12 and prevents the dome from leaving the track during a wind shown by arrows 68. Also shown are additional support hooks 70 and straps 72. Other elements previously disclosed are also shown.

I claim:

1. An apparatus for providing an enclosure for attachment to a building or for covering an area, comprising:

a) a plurality of arcuate panels, said panels having a first and second end, and a first and second side, wherein said panels are generally rectangular, planar panels;

b) a plurality of arcuate frame members, said frame members having a first and second end, and a first and second side for receiving said panels, and an inner and an outer surface;

c) a pair of end panels for attachment to the ends of the enclosure to complete the enclosure;

d) means-for a plurality of horizontal frame members whereby the ends of the arcuate frame members are secured;

e) means for a plurality of rollers disposed on said horizontal frame members whereby said horizontal frame members are movable thereon;

f) means for a plurality of horizontal rails whereby the rollers are rollable thereon and the rails are able to be attached to a foundation; and, g) wherein said plurality of arcuate panels and said plurality of arcuate frame members are sized so that arcuate panels and arcuate frame members of smaller diameter are disposed toward the interior of said panels and frame members of larger diameter so that said panels and frame members are able to telescope one within each other, wherein said arcuate panels approximate the shape of one of a circumference of half a circle or one-fourth an ellipse and said end panels are generally flat and removable.

2. The apparatus of claim 1, wherein said arcuate panels approximate the shape of the circumference of half an ellipse.

3. The apparatus of claim 1, wherein said plurality of arcuate frame members further comprise a generally rectangular shaped housing having a pair of horizontally disposed U-shaped receptacles on said outer surface thereof for receiving said first and second sides of said arcuate panels and an inwardly extending flap disposed on said inner surface.

4. The apparatus of claim 3, herein said rectangular shaped housing has a slot therein, said slot disposed on said inner surface thereof for receiving said flap.

5. The apparatus of claim 4, herein said means for a plurality of horizontal frame members further comprise a downwardly disposed U-shaped frame having a plurality of rollers disposed internal said U-shaped frame, said rollers being used for contacting said means for a plurality of horizontal rails.

6. The apparatus of claim 5, wherein said U-shaped frame further comprises a downwardly disposed anchor plate thereon for contacting the rails.

7. The apparatus of claim 6, wherein said anchor plate further comprises a hook disposed on the lower end of said anchor plate.

8. The apparatus of claim 7, wherein said U-shaped frame further comprising an upwardly disposed U-shaped receptacle thereon for receiving said first end of said arcuate panels.

9. The apparatus of claim 8, said means for a plurality of horizontal rails further comprise a base plate upon which plate said rails are mounted and said rails are attached to a foundation.

10. The apparatus of claim 9, wherein said rail has an enlarged, exposed edge for receiving said hook of said anchor plate so that said anchor plate is secured to said rail.

11. The apparatus of claim 10, further comprising means for adding additional rails to said rail base plate whereby the number of rails varies.

12. The apparatus of claim 11, wherein said means for adding additional rails further comprises a slot disposed in the edge of said base plate for receiving the edge of another base plate.

13. Then apparatus of claim 12, further comprising a stop rod and an end plug disposed in the end of said rail.

14. The apparatus of claim 13, further comprising a cover for being placed over the tops of said rails and a spacer for being placed between said rails to enable one to walk over said rails.

15. The apparatus of claim 4, further comprising a plurality of hooks and straps for securing said arcuate panels to said arcuate frame members.

16. The apparatus of claim 15, wherein said arcuate panels are transparent.

* * * * *